US011084711B2

(12) United States Patent
Yeung

(10) Patent No.: US 11,084,711 B2
(45) Date of Patent: Aug. 10, 2021

(54) PAD

(71) Applicant: SHARPWELL TECHNOLOGY LIMITED, Hong Kong (CN)

(72) Inventor: Kim Ching Yeung, Hong Kong (CN)

(73) Assignee: SHARPWELL TECHNOLOGY LIMITED, Hong Kong (CN)

( * ) Notice: Subject to any disclaimer, the term of this patent is extended or adjusted under 35 U.S.C. 154(b) by 630 days.

(21) Appl. No.: 15/318,217

(22) PCT Filed: Mar. 6, 2015

(86) PCT No.: PCT/CN2015/073769
§ 371 (c)(1),
(2) Date: Mar. 8, 2017

(87) PCT Pub. No.: WO2015/131849
PCT Pub. Date: Sep. 11, 2015

(65) Prior Publication Data

US 2017/0245651 A1 Aug. 31, 2017

(30) Foreign Application Priority Data

Mar. 7, 2014 (CN) ..... 201410081398.6

(51) Int. Cl.
*B68G 5/02* (2006.01)
*A47G 9/00* (2006.01)
(Continued)

(52) U.S. Cl.
CPC ..... *B68G 5/02* (2013.01); *A47C 7/20* (2013.01); *A47C 27/00* (2013.01); *A47C 27/085* (2013.01);
(Continued)

(58) Field of Classification Search
CPC ..... A47C 27/00; A47C 27/16; A47C 27/085; A47C 7/20; A47C 31/005; A47C 31/007;
(Continued)

(56) References Cited

U.S. PATENT DOCUMENTS 2,369,006 A * 2/1945 Banks ..... B63C 9/08 156/221
2,584,313 A * 2/1952 Woodman ..... A43D 25/10 12/38
(Continued)

FOREIGN PATENT DOCUMENTS

CN 201403930 2/2010
CN 201557835 8/2010
(Continued)

OTHER PUBLICATIONS

PCT/CN2015/073769, International Search Report with English Translation, dated May 26, 2012, 8 pages.
(Continued)

*Primary Examiner* — David R Hare
(74) *Attorney, Agent, or Firm* — Kilpatrick Townsend & Stockton LLP

(57) ABSTRACT

This invention provides a mat, comprising: an upper surface; a lower surface; a porous structure located between said upper surface and said lower surface, said porous structure including silica gel. The mat according to this invention can be used as, for example, a pillow, seat cushion, back cushion or mattress, or part of a chair seat or chair back.

20 Claims, 3 Drawing Sheets

(51) Int. Cl.

| | |
|---|---|
| ***A47C 27/00*** | (2006.01) |
| ***A47C 7/20*** | (2006.01) |
| ***A47C 27/16*** | (2006.01) |
| ***A47C 31/00*** | (2006.01) |
| ***A47G 9/10*** | (2006.01) |
| ***B68G 11/04*** | (2006.01) |
| ***A47C 27/08*** | (2006.01) |

(52) U.S. Cl.
CPC ..... *A47C 27/16* (2013.01); *A47C 31/005* (2013.01); *A47C 31/007* (2013.01); *A47G 9/007* (2013.01); *A47G 9/10* (2013.01); *B68G 11/04* (2013.01); *A47G 2009/008* (2013.01); *A47G 2009/1018* (2013.01)

(58) Field of Classification Search
CPC .... A47G 9/10; A47G 9/007; A47G 2009/008; A47G 2009/1018; B68G 11/04; B68G 5/02
See application file for complete search history.

(56) References Cited

U.S. PATENT DOCUMENTS 2,588,823 A * 3/1952 Glassman ..... A47C 27/15 428/134
3,381,999 A * 5/1968 Steere, Jr. ..... A47C 27/144 264/129
3,605,145 A * 9/1971 Graebe ..... A47C 27/081 297/DIG. 3
3,638,255 A * 2/1972 Sterrett ..... A47C 7/021 5/641
3,707,009 A * 12/1972 Wagner ..... A47C 27/144 428/116
4,603,445 A * 8/1986 Spann ..... A47C 27/146 428/131
4,612,225 A * 9/1986 Graffam ..... E04C 2/20 264/164
4,686,724 A * 8/1987 Bedford ..... A61G 7/05707 5/652.1
5,007,123 A * 4/1991 Salyards ..... A47C 27/005 5/483
5,027,458 A * 7/1991 Osczevski ..... A47C 27/00 5/700
5,052,068 A * 10/1991 Graebe ..... A47C 7/021 297/452.23
5,430,901 A * 7/1995 Farley ..... A47C 27/144 156/252
5,749,111 A * 5/1998 Pearce ..... A43B 13/04 5/654
D516,855 S * 3/2006 Akamatsu ..... A47C 27/081 D6/601
7,930,782 B2 * 4/2011 Chen ..... C08L 53/02 5/636
8,359,689 B2 * 1/2013 Warren ..... A47C 27/15 5/655.9
8,932,692 B2 * 1/2015 Pearce ..... A47C 27/056 156/242
D840,724 S * 2/2019 Dowd ..... A47C 27/005 D6/601
10,384,414 B2 * 8/2019 Marson ..... B32B 3/04
2005/0060807 A1 * 3/2005 Kaizuka ..... A47G 9/007 5/636
2012/0233784 A1 * 9/2012 Wood ..... A47C 27/085 5/727
2013/0318722 A1 * 12/2013 Kim ..... A47C 27/056 156/242

FOREIGN PATENT DOCUMENTS

| | | |
|---|---|---|
| CN | 102160726 | 8/2011 |
| CN | 202664918 | 1/2013 |
| CN | 203059037 | 7/2013 |
| CN | 203195154 | 9/2013 |
| CN | 203302709 U | 11/2013 |
| CN | 103619216 | 3/2014 |
| CN | 203953031 U | 11/2014 |
| DE | 202007011758 | 11/2007 |
| HK | 1191501 A2 | 7/2014 |
| JP | 2005082926 | 3/2005 |
| JP | 3139396 | 1/2008 |

OTHER PUBLICATIONS

PCT/CN2015/073769, Written Opinion with English translation, dated May 25, 2015, 11 pages.
Chinese Application No. 201410081398.6, Office Action dated May 29, 2018, 19 pages (10 pages of English translation and 9 pages of Original document).
Chinese Application No. CN201410081398.6, Office Action dated Jan. 28, 2019, 12 pages.
International Application No. PCT/CN2015/073769, International Preliminary Report on Patentability dated Sep. 22, 2016, 13 pages (4 pages of Original Document and 9 pages of English Translation).
Chinese Application No. CN201410081398.6, Office Action dated Aug. 20, 2020, 8 pages.

* cited by examiner

PAD

CROSS-REFERENCE TO RELATED APPLICATIONS

The present application is a § 371 National Phase Application of PCT/CN2015/073769, filed Mar. 6, 2015, which application claims priority to CN 201410081398.6, filed Mar. 7, 2014, the disclosures of which are hereby incorporated by reference in their entireties for all purposes.

TECHNICAL FIELD

The present invention relates to a mat, in particular a mat having a porous structure made of silica gel, such as a seat cushion, back cushion, mattress, pillow, etc.

BACKGROUND ART

Mats have a wide range of applications in everyday life. People have high demands and expectations in comfortability of these mats. As people's living standards have improved, the health care function of mats has been heeded all the more. Besides, in some industries, there are some special requirements on mats. For example, as far as hotel industry is concerned, hotels require their seat cushions, back cushions, pillows, etc. to be antibacterial and easy to clean; and as far as infant products (such as baby pillows, seat cushions of baby carriages, etc.) are concerned, these products require high safety demands and realization of support without affecting the skeletal development of infants.

To this end, the present invention provides a mat to achieve the expectations of the prior art. The mat of the present invention is made mainly of silica gel and has a porous structure. The mat of the present invention may be used as a seat cushion, back cushion, pillow, mattress or the like.

CONTENTS OF INVENTION

The present invention relates to a mat, comprising: an upper surface; a lower surface; a porous structure located between the upper surface and the lower surface, the porous structure comprising a silica gel, wherein the porous structure comprises a stacked array of a plurality of hollow cells having a certain length, the plurality of hollow cells defining a size of the porous structure.

In one embodiment of the present invention, the plurality of hollow cells each have a polygonal, triangular, circular or elliptical cross-section.

In one embodiment of the present invention, the plurality of hollow cells have different cross-sectional areas.

In one embodiment of the present invention, the plurality of hollow cells are arranged in parallel to each other, and extend the entire length of the porous structure.

In one embodiment of the present invention, the porous structure comprises a plurality of layers stacked on one another, said layers having a zigzag configuration to define a wall surface of the plurality of hollow cells.

In one embodiment of the present invention, adjacent ones of the layers are bonded to each other by an adhesive or thermal bonding.

In one embodiment of the present invention, adjacent ones of the layers comprise silica gels having different elastic modulus, hardness, or strength.

In one embodiment of the present invention, the arrangement of the plurality of hollow cells is irregular.

In one embodiment of the present invention, adjacent ones of the layers are bonded to each other by an adhesive or thermal bonding.

In one embodiment of the present invention, the plurality of hollow cells are integrally manufactured.

In one embodiment of the present invention, the wall surface of the plurality of hollow cells is provided with at least one aperture.

In one embodiment of the present invention, the upper surface comprises a flannel surface, and the lower surface comprises a non-slip surface.

In one embodiment of the invention, the porous structure comprises at least one of a far-infrared material, anion material, antibacterial material, fragrance material, and reinforcing material.

In one embodiment of the present invention, the at least one of the far-infrared material, anion material, antibacterial material, fragrance material, and reinforcing material is filled into at least a portion of the hollow cells.

In one embodiment of the present invention, the at least one of the far-infrared material, anion material, antibacterial material, fragrance material, and reinforcing material is mixed into the silica gel prior to manufacture.

In one embodiment of the present invention, the at least one of the far-infrared material, anion material, antibacterial material, fragrance material, and reinforcing material is applied to the upper surface and/or the lower surface.

In one embodiment of the present invention, the far-infrared material comprises one or more of far-infrared ceramic powder, biochar and tourmaline.

In one embodiment of the present invention, the anion material includes one or more of tourmaline, opal, coral fossil, seabed sediments and seaweed charcoal.

In one embodiment of the present invention, the reinforcing material is used to alter the mechanical properties of the hollow cells.

In one embodiment of the invention, the mat is a pillow, seat cushion, back cushion or mattress, or is part of a chair seat or chair back.

BRIEF DESCRIPTION OF DRAWINGS

For better understanding of the present invention, the Figures and the related embodiments of the present invention are described as follows.

PREFERRED EMBODIMENTS

The contents of the present invention will be described in detail with reference to the accompanying drawings. The detailed description and drawings herein are exemplary only, and shall not be construed as restricting the present invention.

Figure 1:
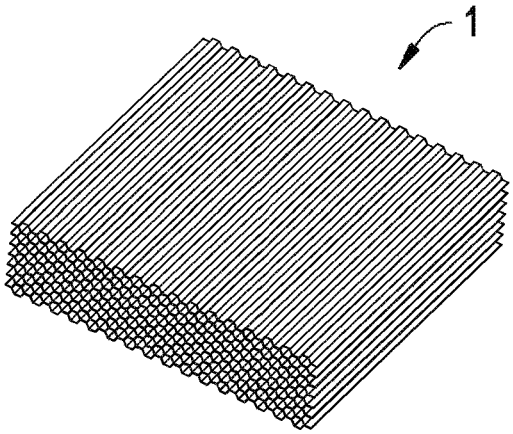
FIG. 1 illustrates a perspective view of a mat according to one embodiment of the present invention.

FIG. 1 shows a mat 1 according to one embodiment of the present invention. Although FIG. 1 shows that the mat 1 has a substantially cuboid configuration, other configurations of the mat 1 are also possible. For example, mat 1 may have a cylindrical shape, spherical shape, or the like, or may have a desired irregular shape resulted from filling one or more mats 1 into a casing having a predetermined profile.

Figure 2:
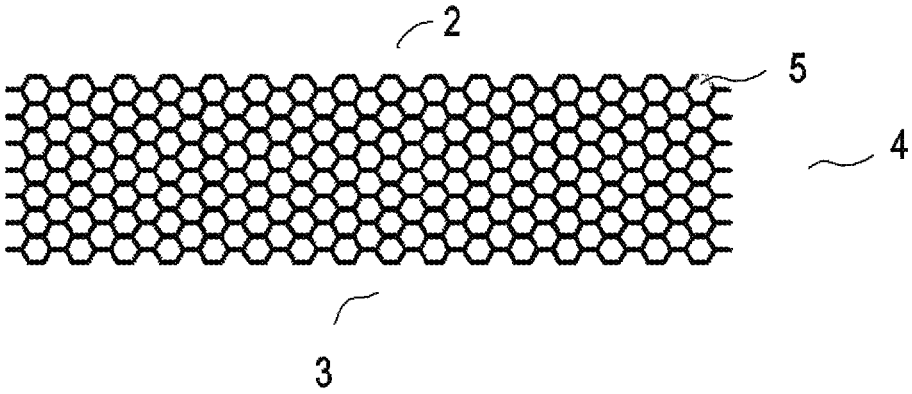
FIG. 2 illustrates a side view of the mat according to one embodiment of the present invention.

FIG. 2 shows a mat 1 viewed from the side. The mat 1 has an upper surface 2, a lower surface 3, and a porous structure 4 located between the upper surface 2 and the lower surface 3.

Figure 3:
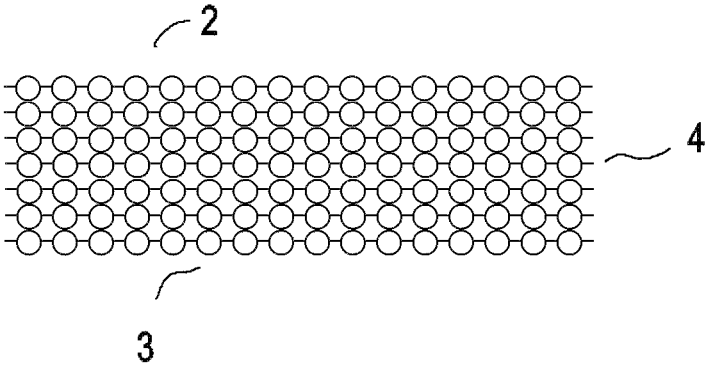
FIG. 3 illustrates a side view of a mat according to another embodiment of the present invention.

The porous structure 4 may be formed by stacking a plurality of hollow cells 5. The hollow cell 5 has a generally hollow tube configuration; adjacent hollow cells 5 may share a wall, or they may have respective independent walls. These hollow cells 5 may have a hexagonal cross-section, so that they form a honeycomb configuration as seen from their cross-section. These hollow cells 5 may also have other regular or irregular cross sections such as, but not limited to, circular, elliptical, triangular or polygonal shapes (see FIGS. 3 and 4). The cross-sectional shapes and cross-sectional areas of the different hollow cells 5 may be different from each other, so as to allow application of different hollow cells 5 for different purposes, which will be discussed further below.

In one embodiment, as shown in FIG. 1, the plurality of hollow cells 5 of the porous structure 4 extend a certain distance in the longitudinal direction to define a length of the porous structure 4; the plurality of hollow cells 5 are laterally arranged to define a width of the porous structure 4; and the plurality of the hollow cells 5 are arranged along the height direction to define a height of the porous structure 4

Figure 4:
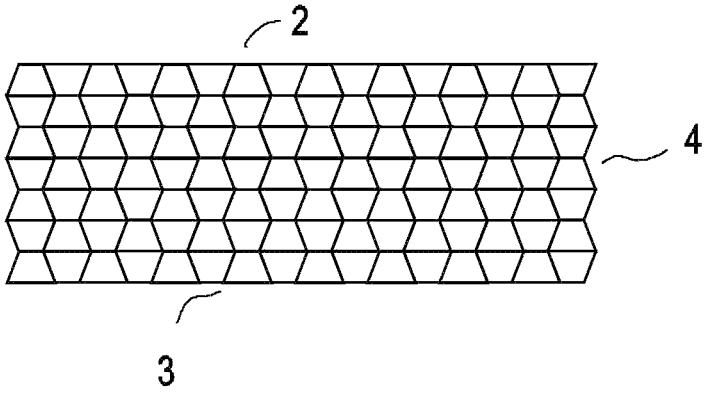
FIG. 4 illustrates a side view of a mat according to a further embodiment of the present invention.

In another embodiment, the plurality of hollow cells 5 of the porous structure 4 are irregularly arranged. In particular, the porous structure 4 may be composed of a plurality of hollow cells 5, or a plurality of cell bundles 6 composed of at least one hollow cell 5 as shown in FIG. 4. Each hollow cell 5 or cell bundle 6 does not necessarily have to extend the entire length of the porous structure along the longitudinal direction of the porous structure, nor along the longitudinal direction of the porous structure. The plurality of hollow cells 5 or cell bundles 6 may have different orientations and/or different lengths. Their combination defines the size of the porous structure.

In one embodiment, different hollow cells 5 or cell bundles 6 may be formed of different silica gels such that different hollow cells 5 or cell bundles 6 have different mechanical properties, such as different elasticities, hardnesses, flexural moduli, or strengths.

Thus, by enable the hollow cells 5 or cell bundles 6 to have different silica gel materials, different cross-sectional areas, different lengths and/or different orientations, the porous structure 4 may obtain the same or variable, desired mechanical properties along its length, width and/or height direction.

For example, it is likely desirable for a pillow to have a softer characteristic, so a softer silica gel material may be used; each hollow cell may have a larger cross-sectional area and a longer length, and extend substantially along a plane perpendicular to the height direction. However, it is likely desirable for a mattress to have a harder characteristic, so that a harder silica gel material may be used; the cross-sectional area of each hollow cell may also be smaller, and some of the hollow cells may be enabled to extend substantially along the thickness direction of the mattress.

Figure 5:
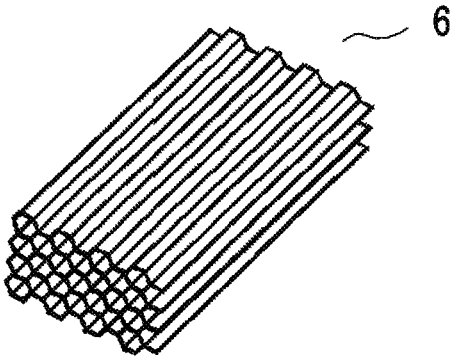
FIG. 5 illustrates a cell bundle according to one embodiment of the present invention.
Figure 6:
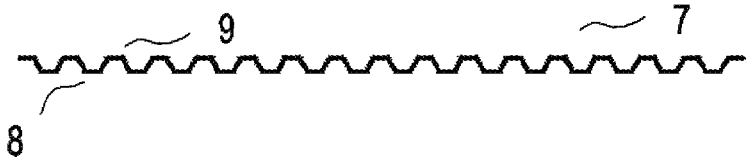
FIG. 6 illustrates a layer constituting a porous structure according to one embodiment of the present invention.

In one embodiment, the porous structure 4 may be stacked along the height direction by a plurality of layers 7. As shown in FIG. 5, each layer 7 has a zigzag configuration to define a wall surface of at least a portion of the plurality of adjacent hollow cells. The zigzag configuration is generally rectilinear and has a corresponding concave 8 and convex 9 depending on the cross-sectional shape of the desired hollow cells 5. Alternatively, the zigzag configuration may simply be a lateral combination of the plurality of hollow cells 5. The number of layers 7 depends on a desired thickness of the mat. Adjacent layers 7 are bonded to each other by, for example, an adhesive, or may be bonded to each other by other suitable manners such as thermal bonding.

In another embodiment, the porous structure 4 may be integrally extruded, molded, or injection-molded, i.e. the plurality of hollow cells 5 may be simultaneously formed in one step.

In another embodiment, each of the hollow cells 5 or cell bundles 6 of the porous structure 4 may be separately formed and then combined with each other in a regular or random manner, thereby enabling easy customization of the desired mechanical properties and ergonomic need.

In a preferred embodiment, one or more arrays of apertures (not shown) may be formed on the wall surface of the porous structure. The one or more arrays of apertures preferably achieve an air passage extending through at least one of the length, width and height directions of the porous structure.

The porous structure 4 of the present invention is composed mainly of silica gel. Silica gel is non-toxic, tasteless, and chemically stable; thus, it is an ideal material for mats.

On the other hand, silica gel is stable in properties, insoluble in water or any solvent, and does not react with any other substances except strong alkalis and hydrofluoric acids. Therefore, the mat of the present invention is suitable for repeated washing with water, and is also suitable for cleaning and sterilization with high temperature steam, hence making it particularly suitable for manufacturing seat cushions, back cushions, pillows or the like for use in hotels and hospitals.

In another aspect, silica gel materials are often formed with different microporous structures according to their manufacturing processes. These microporous structures enable the silica gels to have a strong adsorption capacity, which can produce a drying function on a human body skin and is thus particularly suitable for use in zones of humid climate. And silica gels also have high breathability, and are therefore particularly suitable for use in summertime.

In a further aspect, silica gels also have excellent flame retardance. For some fire-retardant silica gels, their flame-retardant properties can reach FV-0 grade (GB/T2408). Moreover, silica gels do not emit thick smoke or toxic gases during combustion; therefore, the silica gel mat of the present invention is particularly suitable for use in public places such as hotels, theaters, hospitals or the like, which have higher requirements on fireproof performance.

Silica gel also has a slow resilience characteristic based on its own properties, and the inventor of the present invention has surprisingly found that the aforesaid slow resilience characteristic enables silica gel to be particularly suitable for use in making mats. For existing mats, the degree of softness and resilience tend to be difficult to achieve a desirable balance. Soft mats are often difficult to effectively rebound; that is, it is impossible to use the material of the mats per se to withstand most of the pressure;

and deformed mats also cannot maintain an effective supporting surface. On the other hand, mats with stronger rebound are often harder, which greatly reduces comfortability. Besides, after prolonged use, the shapes of the existing mats often fail to fully recover their original ones.

However, for a silica gel material, when it is subject to pressure, elastic deformation occurs, and then plastic deformation also occurs, wherein plastic deformation consumes most of the energy, while elastic deformation accumulates part of the energy. Thus, the aforesaid elastoplastic deformation causes the mat to exhibit a soft characteristic. On the other hand, after the external force is removed, the energy accumulated in the elastic deformation causes the silica gel material to gradually restore it pre-compression shape. As a result, the mat can substantially maintain in its original shape over a long period of use.

In addition, the mat of the present invention, when subjected to pressure, is sufficiently deformed to conform to the contour of the pressure-applying surface, diffusing the supporting point to over the entire contact surface, and allowing the pressure to be spread over the entire contact surface. When a person sits, lies and leans on the mat, because the pressure is dispersed, his body does not contain any pressure-centralized point, and thus comfort is greatly improved, which hence can better prevent issues such as bedsore caused by blockage in blood circulation caused by great pressure over a long period of time, and also is particularly suitable for use by infants and the elderly.

Another improvement of the present invention lies in the previously described porous structure of silica gel. The inventor of the present invention has surprisingly found that the resilience characteristic of the mat can further be enhanced by the porous structure. So a good balance between the softness and the supporting ability is achieved not only by the properties of the silica gel material per se, but also by the structural deformation of the porous structure and the relative displacement of the internal cells of the structure. Further, the porous structure described above enables the desired mechanical properties to be configured in accordance with different applications of the mat, different applicable groups of people, different preferences, or the like.

In other embodiments, the material forming the porous structure 4 may also include functional materials such as far-infrared material, anion material, antibacterial material, fragrance material, reinforcing material, etc.

The far-infrared material is adapted to be capable of emitting far-infrared rays of 3-15 μm around room temperature (20-50° C.), so as to match the infrared absorption spectrum of the human body. Studies have shown that far-infrared absorption by the body can make the water molecules inside the body resonate, so as to activate the water molecules and enhance their intermolecular binding power, thereby activating biological macromolecules such as proteins, etc., so that the biological cells are at the highest level of vibration. Because the biological cells produce resonance effect, far-infrared heat energy can be transferred to deeper parts beneath the skin of the human body; the temperature of the deeper layers below rise; the heat produced is dispersed from the inside out. The intensity of such action enables blood vessels to dilate, promoting blood circulation, strengthening the metabolism between various tissues, increasing tissue regeneration, improving the immune capabilities of the body, regulating the abnormal state of excitement of spirit, and thus performing a medical health care function.

Suitable far-infrared ceramic powders include far-infrared ceramic powder. In one embodiment of the present invention, the far-infrared ceramic powder comprises 10-20% by mass of $SiO_2$, 10-20% by mass of $MnO_2$, 15-30% by mass of $Al_2O_3$, 4-10% by mass of CaO, 15-30% by mass of MgO, 5-20% by mass of $Fe_2O_3$, 20-50% by mass of $ZrO_2$, and 1-5% by mass of AgCl. In another embodiment, the far-infrared ceramic powder comprises $SiO_2$, $TiO_2$, $Al_2O_3$, $Na_2CO_2$, borax minerals and incorporates small amounts of $Fe_2O_3$, $MnO_2$, $Co_2O_3$ and CuO. Other suitable far-infrared materials further include biochar (e.g. bamboo charcoal powder, bamboo charcoal fibers), tourmaline, or the like.

The anion material is adapted to stably release negative ions into the air for a long period of time to be ingested by the human body. Studies have shown that negative ions can enhance cerebral cortex functions and mental activities, spirits and work efficiency, and can improve sleep quality. Negative ions can also intensify and strength the oxidation process of brain tissues, so that the brain tissues obtain more oxygen. In addition, negative ions can function to significantly dilate blood vessels, and can relieve arterial vasospasm, achieving the purpose of reducing blood pressure. Negative ions also favor improving cardiac function and improving myocardial nutrition, and are conducive to recovery of patients from high blood pressure and cardiovascular and cerebrovascular diseases. Negative ions also have the function of prolonging blood coagulation, enabling an increase in oxygen content in the blood, and facilitating delivery, absorption and utilization of blood oxygen.

Suitable anion materials mainly include natural minerals such as tourmalines, opals (aqueous amorphous or colloidal activated $SiO_2$ and small amounts of $Fe_2O_3$, $Al_2O_3$, etc.), and tourmalines (inorganic porous substances formed by silicates and metal oxides of aluminum and iron), as well as seabed minerals, such as coral fossils, seabed sediments, seaweed charcoal, etc.

In addition, the antibacterial material itself has the function of killing or inhibiting microorganisms. And said fragrance material is adapted to continuously impart aroma into the air. Appropriate antibacterial materials and aromatic materials can be selected as required.

Figure 7:
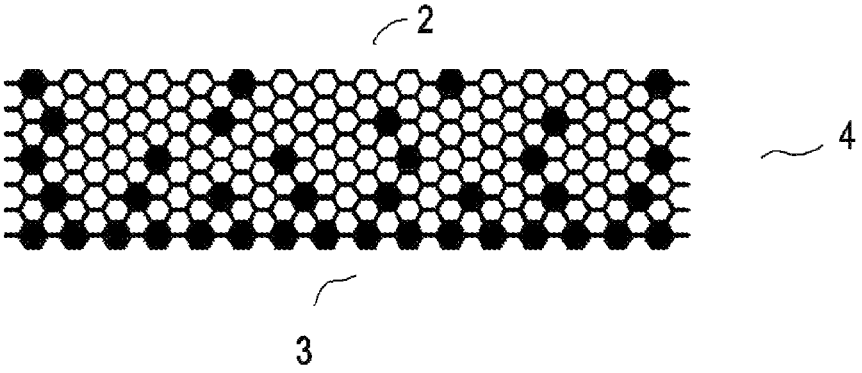
FIG. 7 illustrates a porous structure filled with a functional material according to one embodiment of the present invention.
Figure 8:
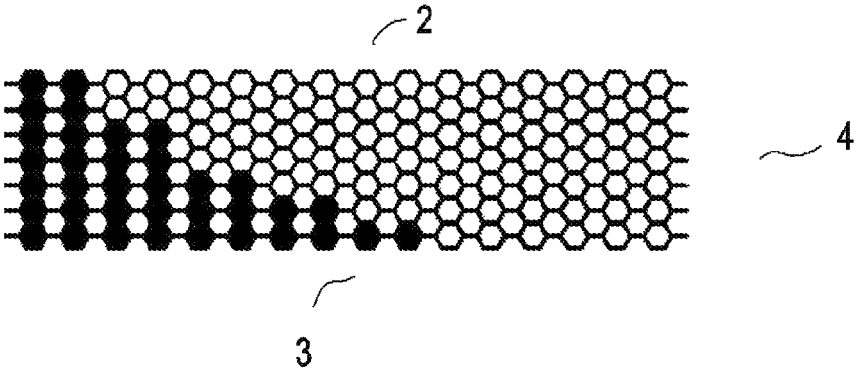
FIG. 8 illustrates a porous structure filled with a functional material according to another embodiment of the present invention.

Reinforcing material may also be added to the porous structure of the present invention, for altering the mechanical properties of the structure. As shown in FIG. 7, in one embodiment, some of the hollow cells 5 are filled with a reinforcing material while the interiors of the other of the hollow cells 5 are kept hollow. The porous structure so filled enables the porous structure to have a variable elastic modulus in the direction of its height. As shown in FIG. 8, in another embodiment, the number of the hollow cells filled with the reinforcing material decreases from one side to the other side. Thus, when the mat is used as a pillow, it is possible to reduce deformation at the neck support portion and provide a higher supporting force, while allowing the head to sag at the head support portion, so that a stiff neck can be well avoided.

The filling manners as shown in FIGS. 7 and 8 can also be applied to other functional materials.

It will be appreciated by those skilled in the art that the porous structure of the present invention may also include other suitable functional materials in addition to the materials described above.

In one preferred embodiment, various functional materials such as a far-infrared material, anion material, reinforcing material, etc. can be uniformly mixed with a liquid silica gel, and then a desired configuration can be molded by a mold.

In another preferred embodiment, the various functional materials such as the far-infrared material, anion material, reinforcing material, etc., can be filled into each of the hollow cells of the porous structure or into at least some gaps between each of the hollow cells. In particular, the present invention can provide a first hollow cell having a larger cross-sectional area and a second hollow cell having a smaller cross-sectional area, wherein the second hollow cell can be used to fill the functional material and the first hollow cell can be kept hollow to allow sufficient deformation of the porous structure when subjected to compression.

In another preferred embodiment, the various functional materials such as the far-infrared material, anion material, etc. described above are applied to the surface of the porous structure 4 only. In another embodiment, the upper surface 2 of the mat may be provided with a plurality of protrusions, and the various functional materials such as the far-infrared material, anion material, etc. may be provided only in the interior of the plurality of protrusions.

In one embodiment, the upper surface 2 and the lower surface 3 of the mat of the present invention may have components different from those of the porous structure 4. For example, the bottom layer 3 may be a non-slip material and the top layer 3 may be a plush material. In another embodiment, the upper surface 2 and the lower surface 3 of the mat of the present invention, i.e. the upper surface and the lower surface of the porous structure, are further accommodated into a cushion cover for use. Said cushion cover preferably has good breathability.

The mat of the present invention may be used for various applications. For example, the mat of the present invention can be used as a pillow, seat cushion, back cushion, mattress, etc. The mat of the present invention may further be formed as, for example, a seat cushion portion of a chair, a seat cushion portion of a stroller, etc.

The above description are only some of the embodiments of the present invention; therefore, all equivalent variations or modifications made in accordance with the construction, features and principles set forth in the appended claims, and any combinations of the embodiments of the present invention, are included in the scope of protection as claimed by the present invention.

The invention claimed is:

1. A mat (1), comprising:

an upper surface (2);

a lower surface (3); and a porous structure (4) located between said upper surface (2) and said lower surface (3), said porous structure (4) comprising silica gel wherein said porous structure (4) comprises a stacked array of a plurality of hollow cells (5) having a predetermined length, the plurality of hollow cells (5) defining a size of the porous structure (4), wherein the plurality of hollow cells (5) are stacked along a height direction between the upper surface (2) and the lower surface (3), such that the stacked plurality of hollow cells defines a height of the porous structure (4), wherein the plurality of hollow cells extend substantially along a plane perpendicular to the height direction, wherein the porous structure further comprises at least one of a far-infrared material, anion material, antibacterial material, fragrance material, and reinforcing material, wherein the antibacterial material kills or inhibits microorganisms, and wherein when the porous structure comprises the far-infrared material, the far-infrared material comprises one or more of far-infrared ceramic powder, biochar and tourmaline.

2. The mat of claim 1, wherein the plurality of hollow cells (5) each have a polygonal, triangular, circular or elliptical cross-section.

3. The mat of claim 1, wherein the plurality of hollow cells (5) have different cross-sectional areas.

4. The mat of claim 1, wherein the plurality of hollow cells (5) are arranged in parallel to each other, and extend the entire length of the porous structure (4).

5. The mat of claim 1, wherein the porous structure comprises a plurality of layers (7) stacked on one another, said layers (7) having a zigzag configuration to define a wall surface of the plurality of hollow cells (5).

6. The mat of claim 1, wherein adjacent ones of the layers (7) are bonded to each other by an adhesive or thermal bonding.

7. The mat of claim 1, wherein adjacent ones of the layers (7) comprise silica gels having different elastic modulus, hardness, or strength.

8. The mat of claim 1, wherein the arrangement of the plurality of hollow cells (5) is irregular.

9. The mat of claim 1, wherein adjacent ones of the layers (7) are bonded to each other by an adhesive or thermal bonding.

10. The mat of claim 1, wherein the plurality of hollow cells (5) are integrally manufactured.

11. The mat of claim 1, wherein the wall surface of the plurality of hollow cells (5) is provided with at least one aperture.

12. The mat of claim 1, wherein the upper surface (2) comprises a flannel surface, and the lower surface (3) comprises a non-slip surface.

13. The mat of claim 1, wherein the at least one of the far-infrared material, anion material, antibacterial material, fragrance material, and reinforcing material is filled into at least a portion of the hollow cells.

14. The mat of claim 1, wherein the at least one of the far-infrared material, anion material, antibacterial material, fragrance material, and reinforcing material is mixed into the silica gel prior to manufacture.

15. The mat of claim 1, wherein the at least one of the far-infrared material, anion material, antibacterial material, fragrance material, and reinforcing material is applied to the upper surface and/or the lower surface.

16. The mat of claim 1, wherein when the porous structure comprises the reinforcing material, the reinforcing material is used to alter the mechanical properties of the hollow cells (5).

17. The mat of claim 1, wherein the mat (1) is a pillow, seat cushion, back cushion or mattress, or is part of a chair seat or chair back.

18. The mat of claim 1, wherein the reinforcing material is filled into some of the hollow cells and wherein the porous structure has a variable elastic modulus in the direction of its height.

19. The mat of claim 1, wherein the porous structure consists of silica gel.

20. A mat (1), comprising:

an upper surface (2);

a lower surface (3); and a porous structure (4) located between said upper surface (2) and said lower surface (3), said porous structure (4) comprising silica gel wherein said porous structure (4) comprises a stacked array of a plurality of hollow cells (5) having a predetermined length, the plurality of hollow cells (5) defining a size of the porous structure (4), wherein the plurality of hollow cells (5) are stacked along a height direction between the upper surface (2) and the lower surface (3), such that the stacked plurality of hollow cells defines a height of the porous structure (4), wherein the plurality of hollow cells extend substantially along a plane perpendicular to the height direction, wherein the porous structure further comprises at least one of a far-infrared material, anion material, antibacterial material, fragrance material, and reinforcing material, wherein the antibacterial material kills or inhibits microorganisms, and wherein when the porous structure comprises the anion material, the anion material includes one or more of tourmaline, opal, coral fossil, seabed sediments and seaweed charcoal.

* * * * *